US006056525A

United States Patent [19]

Murayama et al.

[11] Patent Number: 6,056,525

[45] Date of Patent: May 2, 2000

[54] VANE COMPRESSOR

[75] Inventors: Toshihiro Murayama; Tomoyasu Takahashi; Yoshiteru Hirao; Hidetoshi Arahata; Katsumi Sakamoto, all of Higashimatsuyama; Syoichi Fukuda, Saitama-ken; Hiroshi Kawahara, Kumagaya; Hiroyuki Suzuki, Oota; Mitsuya Ono, Kawagoe; Kazuo Kume, Saitama-ken; Susumu Makihira, Higashimatsuyama; Shunji Muta, Saitama-ken, all of Japan

[73] Assignee: Zexel Corporation, Tokyo, Japan

[21] Appl. No.: 08/958,266

[22] Filed: Oct. 20, 1997

[30] Foreign Application Priority Data

Oct. 22, 1996 [JP] Japan ..... 8-298072

[51] Int. Cl.[7] ..... F01C 19/08

[52] U.S. Cl. ..... 418/133; 418/179

[58] Field of Search ..... 418/133, 179, 418/132

[56] References Cited

U.S. PATENT DOCUMENTS 4,334,840 6/1982 Teruyama ..... 418/179 X
4,515,513 5/1985 Hayase et al. ..... 418/179 X
4,711,620 12/1987 Takahashi et al. ..... 418/179 X
4,976,592 12/1990 Nakajima et al. ..... 417/295
5,044,908 9/1991 Kawada ..... 418/179
5,240,387 8/1993 Nakajima et al. ..... 417/295
5,356,277 10/1994 Yamaguchi et al. ..... 418/179

*Primary Examiner*—Hoang Nguyen
*Attorney, Agent, or Firm*—Frishauf, Holtz, Goodman, Langer & Chick, P.C.

[57] ABSTRACT

There is provided a vane compressor which prevents leakage of refrigerant gas by decreasing the number of airtight interfaces between component parts and prevents seizure from occurring between its rotor and its side block without surface treatment of the side block. The vane compressor has a cam ring. The rotor is rotatably received in the cam ring. A first head is secured to one end face of the cam ring. A second head is secured to another end face of the cam ring in a manner such that the second head closes an opening of the another end face of the cam ring and one end face of the rotor can be brought into contact with the second head. The side block is received in the first head in a manner such that it closes an opening of the one end face of the cam ring and another end face of the rotor can be brought into contact with the side block.

4 Claims, 5 Drawing Sheets

VANE COMPRESSOR

BACKGROUND OF THE INVENTION

1. Field of the Invention

This invention relates to a vane compressor, and more particularly to a vane compressor having a reduced number of airtight interfaces of component parts which are exposed to space outside the compressor.

2. Description of the Prior Art

FIG. 1 is a longitudinal cross-sectional view showing a conventional vane compressor, and FIG. 2 a view taken on line II—II in FIG. 1.

The vane compressor includes a cam ring 101, a rotor 102 rotatably received in the cam ring, a drive shaft 107 rigidly fitted on the rotor, a front side block 103 secured to a front-side end face of the cam ring 101, a rear side block 104 secured to a rear-side end face of the same, a front head 105 secured to a front-side end face of the front side block 103, and a rear head 106 secured to a rear-side end face of the rear side block 104.

A pair of compression spaces 112 are defined at diametrically opposite locations between an inner peripheral surface of the cam ring 101 and an outer peripheral surface of the rotor 102 (only one of the compression spaces is shown in FIG. 1). The rotor 102 has its outer peripheral surface formed therein with a plurality of vane slits 113, in each of which a vane 114 is radially slidably fitted. Each compression space 112 is divided by the vanes 114 into compression chambers, the volume of each of which is varied with rotation of the rotor 102.

Outlet ports 116 are formed in pair through each of opposite lateral side walls of the cam ring 101 (only one pair of the outlet ports 116 is shown in FIG. 2). The lateral side walls of the cam ring 101 are provided with discharge valve covers 117 each formed integrally with valve stoppers and fixed to the cam ring 101 by bolts 118. Between each lateral wall of the cam ring 101 and an inner wall surface of the discharge valve cover 117, there is formed a discharge space 101*c* to which refrigerant gas is delivered from the compression chambers via the refrigerant outlet ports 116. The discharge space 101*c* is provided with discharge valves 119 for opening/closing the refrigerant outlet ports 116, respectively. The discharge valves 119 are fixed to the inner wall surface of the discharge valve cover 117 by respective bolts 120.

A front-side end of the drive shaft 107 is rotatably supported by a radial bearing 108 arranged in the front side block 103. A rear-side end of the drive shaft 107 is rotatably supported by a radial bearing 109 arranged in the rear side block 104. The radial bearings 108, 109 are made of ferrous material. Therefore, the rear and front side blocks 103 and 104 are formed with recesses 103*a* and 104*a* to provide spaces for casting bushings 130 and 131 formed of ferrous material therein, respectively, so as to prevent the radial bearings 108, 109 from becoming loose due to differences in thermal expansion between the bearings 108, 109 and the side blocks 103, 104.

The above vane compressor is a so-called shell-less compressor which has no shell for covering the whole compressor. In other words, the cam ring 101, the front side block 103, the front head 105, the rear side block 104, and the rear head 106 are all exposed to space outside the compressor. Therefore, the compressor has a lot of interfaces between component parts, which require sealing, and is prone to leakage of refrigerant gas.

Except for the few components, such as the drive shaft 107 and the radial bearings 108, 109, most of the main component parts of the compressor, such as the cam ring 101, the front side block 103, the front head 105, the rear side block 104 and the rear head 106, are formed of aluminum-based material. The end faces of the rotor 102 are brought into sliding contact with the rear-side end face of the front side block 103 and the front-side end face of the rear side block 104 during rotation of the rotor 102. This can cause seizure between the rotor 102 and the front and rear side blocks 103 and 104. To avoid this seizure, the rear-side end face of the front side block 103 and the front-side end face of the rear side block 104 require surface treatment (thin coating of a self-lubricating material).

Further, as described above, the conventional vane compressor requires the recesses 103*a* and 104*a* to be formed in the side blocks 103, 104 at locations around the bearings 108 and 109, respectively, to provide spaces into which the bushings formed of ferrous material 130, 131 are cast. This inevitably complicates the construction of the compressor and makes the machining of the same troublesome.

SUMMARY OF THE INVENTION

It is an object of the invention to provide a vane compressor which prevents leakage of refrigerant gas therefrom by decreasing the number of component parts exposed to space outside the compressor to thereby decrease the number of air-tight interfaces between the component parts, which require sealing, and are capable of preventing seizure from occurring between a side block and a rotor without surface treatment of the side block, with the side block being simplified in construction to facilitate the machining of the same, thereby reducing manufacturing costs of the vane compressor.

To attain the above object, the present invention provides a vane compressor comprising:

a cam ring;

a rotor rotatably received in the cam ring;

a first head secured to one end face of the cam ring;

a second head secured to another end face of the cam ring in a manner such that the second head closes an opening of the another end face of the cam ring, and that one end face of the rotor can be brought into contact with the second head; and a side block received within the first head in a manner such that the side block closes an opening of the one end face of the cam ring, and that another end face of the rotor can be brought into contact with the side block.

According to the vane compressor of the invention, the side block is received in the first head, and the second head is directly secured to the cam ring, so that no component parts except the cam ring and the first and second heads are exposed to the space outside the compressor. Therefore, there are a smaller number of component parts exposed to the space or atmosphere outside the compressor compared with the conventional vane compressors, with a smaller number of air-tight interfaces between the component parts, which require sealing.

Preferably, the rotor is formed of an aluminum-based material, and the side block is formed of a ferrous material.

According to this preferred embodiment, since the side block, with which the end face of the rotor can be brought into immediate sliding contact during rotation of the rotor, is formed of a ferrous material, it has excellent sliding characteristics. Therefore, the side block requires no surface treatment for prevention of seizure between its rotor-side end face and the end face of the rotor.

More preferably, the vane compressor includes a drive shaft on which the rotor is rigidly fitted, and a bearing arranged in the side block for rotatably supporting the drive shaft, the bearing being formed of a ferrous material.

According to this preferred embodiment, since the side block is formed of the ferrous material, there is very little space produced between the radial bearing and the side block when they undergo thermal expansion caused by heat generated during operation of the compressor, so that the radial bearing does not become loose.

Preferably, the first head has an inner wall surface, the side block having an outer peripheral surface, and the inner wall surface of the first head, the outer peripheral surface of the side block, and the one end face of the cam ring define a discharge chamber.

According to this preferred embodiment, a discharge chamber can be easily formed by utilizing the outer peripheral surface of the side block received within the first head.

The above and other objects, features and advantages of the present invention will become more apparent from the following detailed description taken in conjunction with the accompanying drawings.

DETAILED DESCRIPTION OF THE PREFERRED EMBODIMENT

Next, the invention will now be described in detail with reference to drawings showing a preferred embodiment thereof.

Figure 1:
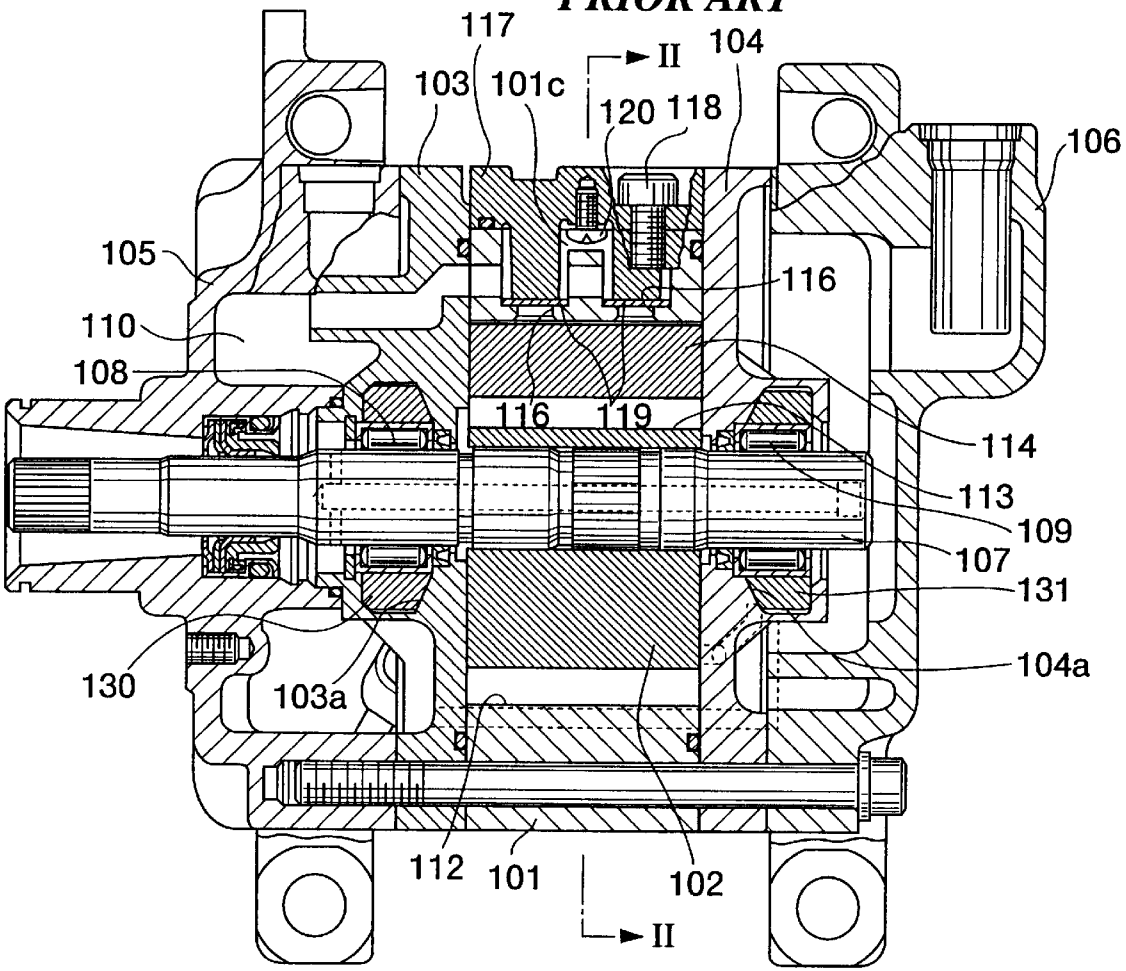
FIG.1 PRIOR ART
FIG. 1 is a longitudinal cross-sectional view showing the whole arrangement of a conventional vane compressor.
Figure 2:
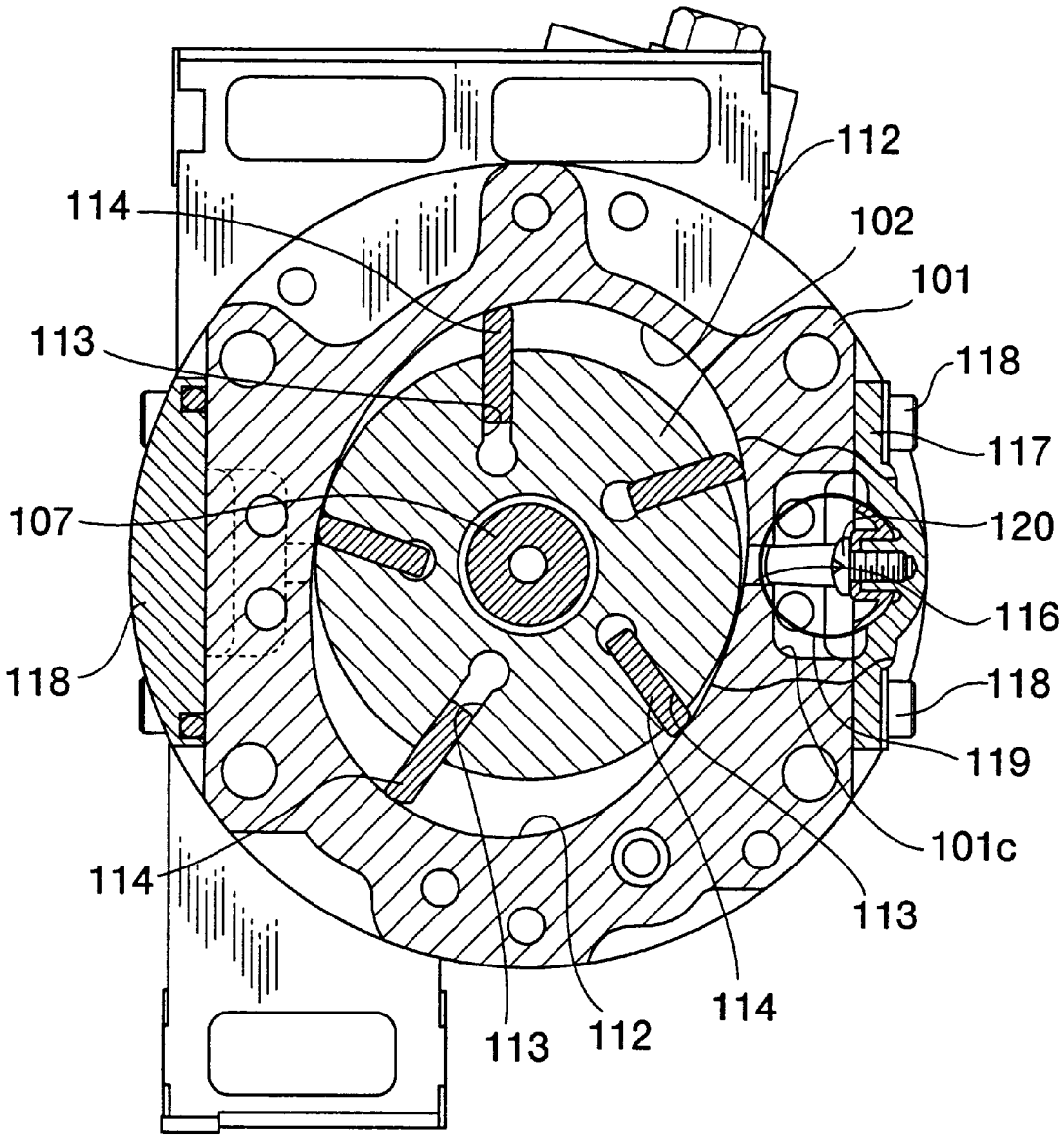
FIG.2 PRIOR ART
FIG. 2 is a cross-sectional view taken on line II—II of FIG. 1.
Figure 3:
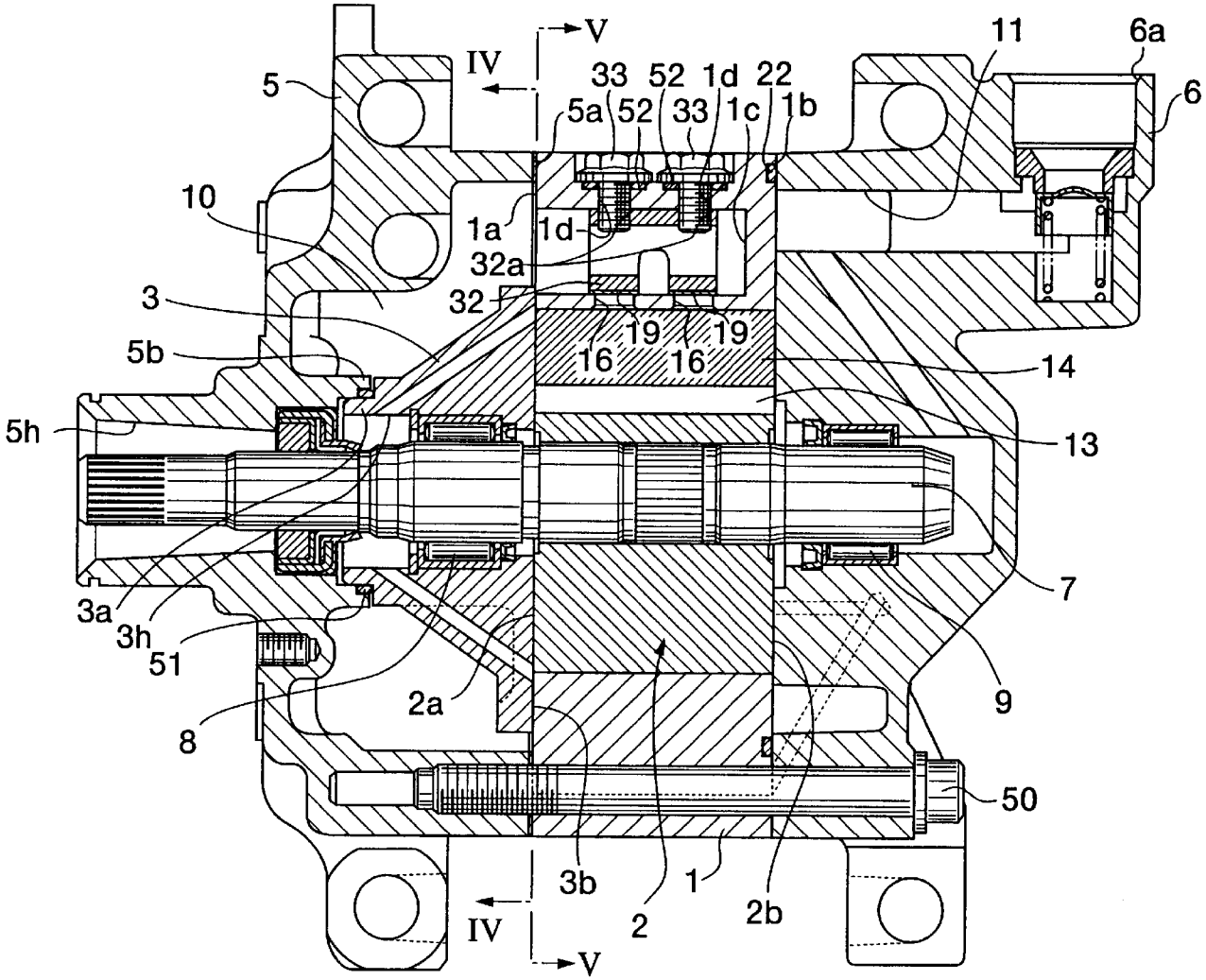
FIG. 3 is a longitudinal cross-sectional view showing the whole arrangement of a vane compressor according to an embodiment of the invention.
Figure 4:
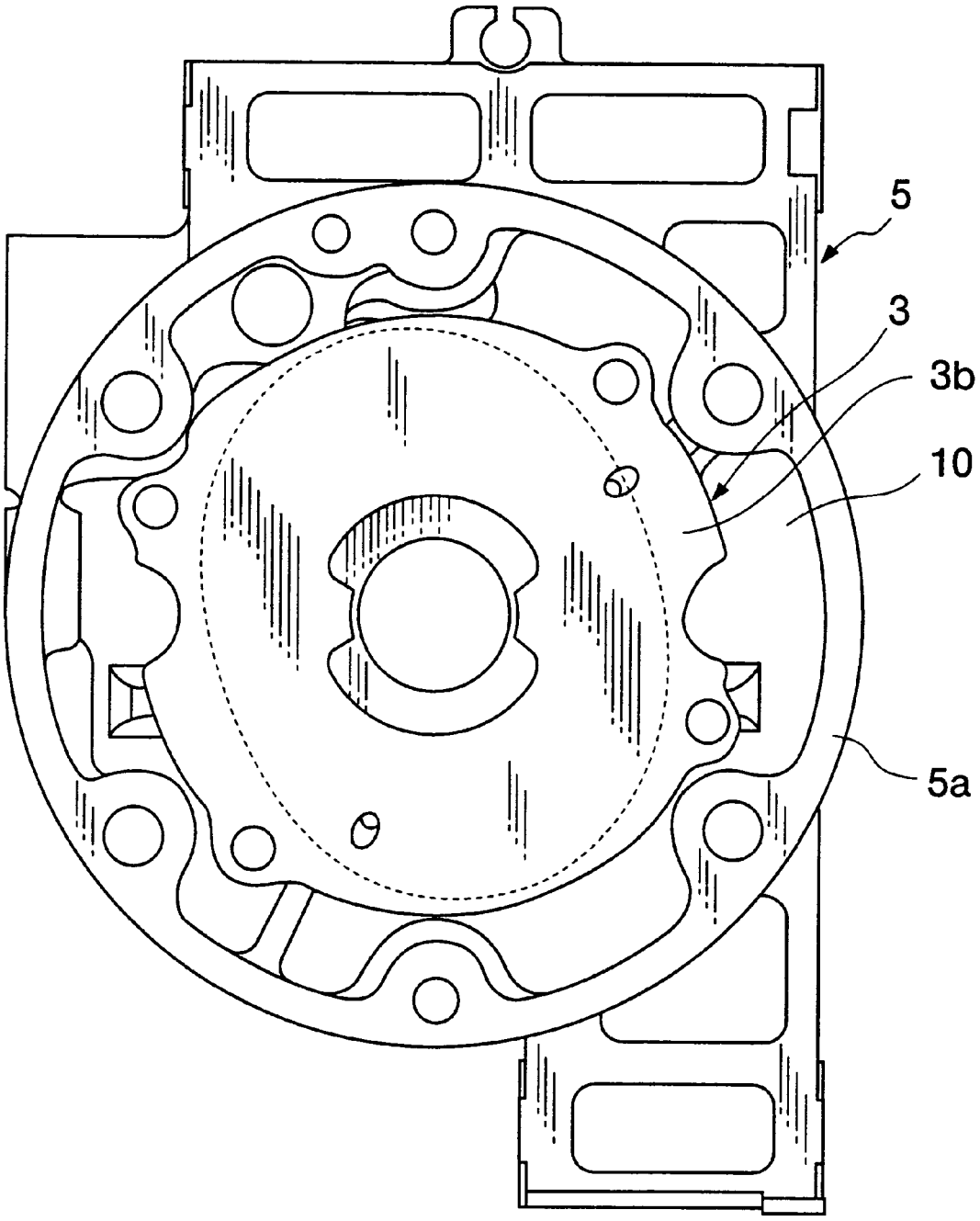
FIG. 4 is an end view of a rear-side end of a front head with a front side block received therein, taken on line IV—IV of FIG. 3.
Figure 5:
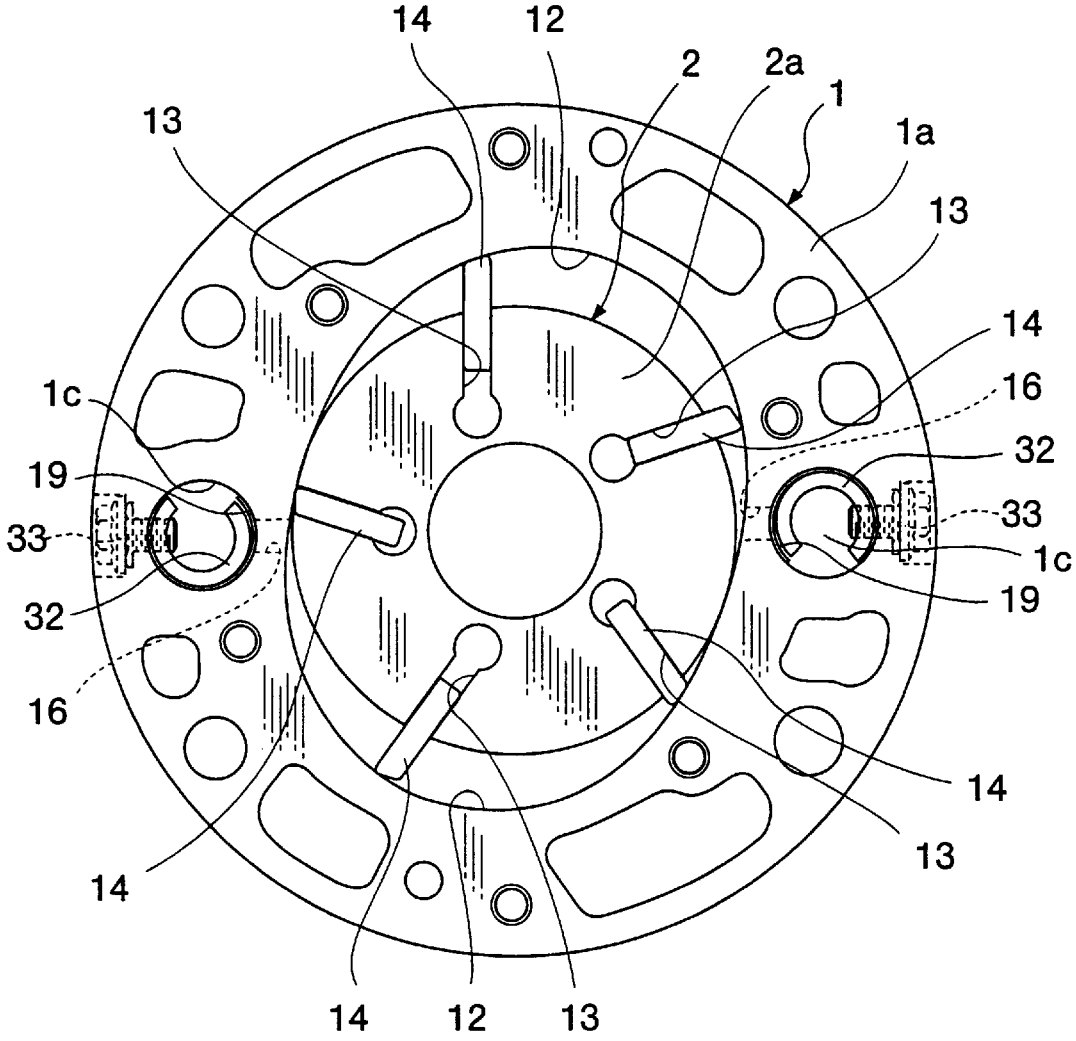
FIG. 5 is an end view of a front-side end of a cam ring, taken on line V—V of FIG. 3.

FIG. 3 shows a vane compressor, in longitudinal cross section, according to an embodiment of the invention. FIG. 4 shows rear-side end faces of a front head and a front side block received in the front head, taken on line IV—IV of FIG. 3. FIG. 5 shows a front-side end face of a cam ring, taken on line V—V of FIG. 3.

The vane compressor is comprised of the cam ring 1, a rotor 2 rotatably received in the cam ring 1, a drive shaft 7 on which is rigidly fitted the rotor 2, the front head (first head) 5 secured to the front-side end face 1*a* (one end face) of the cam ring 1, a rear head 6 (second head) secured to a rear-side end face 1*b* (another end face) of the cam ring 1 via an O ring 22, and the front side block 3 (side block) received in the front head 5. The front head 5 is substantially in the form of a bottomed hollow cylinder, with an open end opening toward the cam ring 3, and a front-side end wall formed with a through hole 5*h* through which the drive shaft 1 extends. The front-side end wall of the front head 3 has a boss 5*b* formed on an inner side thereof around the through hole 5*h*. The cam ring 1, the front side block 3, the front head 5 and the rear head 6 are tightened in a longitudinal direction by a through bolt 50 to form a one-piece assembly. The drive shaft 7 is rotatably supported by a pair of radial bearings 8 and 9 arranged in the front side block 3 and the rear head 6, respectively.

Component parts of the compressor, such as the cam ring 1, the rotor 2, and the front and rear heads 5 and 6, are formed of aluminum-based material, while other component parts, such as the drive shaft 7, the front side block 3 and the radial bearings 8, 9, are formed of ferrous material. As the aluminum-based material, there is employed e.g. a material coded as JDC14 according to JIS. As the ferrous material, there are employed e.g. a material coded as SCM according to JIS for the drive shaft 7, a material coded as FC250 according to the same for the front side block 3, and one coded as SUJ according to the same for the bearings 8, 9.

The front side block 3 has a rear-side end face 3*b* secured to the front-side end face 1*a* of the cam ring 1 in a manner closing a front-side opening (one-side opening) of the cam ring 1. A front-side end face (another end face) 2*a* of the rotor 2 can be brought into contact with the rear-side end face 3*b* of the front side block 3. That is, normally or preferably, the rear side end face 3*b* of the front side block 3 and the front-side end face of the rotor 2 are opposed to each other, with very little clearance therebetween which is filled with lubricant contained in refrigerant when the compressor is in operation. However, occasionally, they can be brought into even more direct sliding contact with each other. The front-side block 3 is substantially in the form of a truncated cone which decreases in diameter to its front-side end 3*a*. The front-side block 3 has a through hole 3*h* formed in the center thereof in a longitudinal direction, through which the drive shaft 1 extends. The front-side end 3*a* of the front side block 3 is rigidly fitted in the boss 5*b* formed on the front-side end wall of the front head 5 via an O ring 51. An inner wall surface of the front head 5, an outer peripheral surface of the front-side block 3, and the front-side end face of the cam ring 1 define a discharge chamber 10 to which high-pressure refrigerant gas is delivered from a plurality of compression chambers, referred to hereinafter.

The rear head 6 closes a rear-side opening (another-side opening) of the cam ring 1 and a rear-side end face (another end face) 2*b* of the rotor 2 can be brought into in contact with the rear head 6. The rear head 6 is formed with a suction port 6*a* via which refrigerant gas is drawn into the compressor. The suction port communicates with a suction chamber 11.

A pair of compression spaces 12 are defined by an inner peripheral surface of the cam ring 1 and an outer peripheral surface of the rotor 2, at respective diametrically opposite locations as shown in FIG. 5. The rotor 2 has its outer peripheral surface formed therein with a plurality of axial vane slits 13 at circumferentially equal intervals, in each of which a vane 14 is radially slidably fitted. Each compression space 12 is divided by the vanes 14 into compression chambers, the volume of each of which is varied with rotation of the rotor 2.

Further, the cam ring 1 is formed therein with discharge spaces (discharge valve-receiving chambers) 1*c*, each of which accommodates discharge valves 19, referred to hereinafter. A front side of each discharge space 1*c* is open to the discharge chamber 10. FIG. 3 shows only one of the discharge spaces 1*c*. Two pairs of refrigerant outlet ports 16 are formed through opposite lateral side walls of the cam ring 1, which separate the discharge spaces 1*c* and the compression spaces 12 from each other, in a fashion corresponding to the compression spaces 12 (only one pair of the refrigerant outlet ports 16 is shown in FIG. 3). When the refrigerant outlet ports 16 open, high-pressure refrigerant gas is delivered from compression chambers via the refrigerant outlet ports 16, and flows into the discharge chamber 10 through the discharge spaces 1*c*.

Each discharge space 1*c* accommodates a valve stopper 32 arcuate in cross section, with the discharge valves 19 also arcuate in cross section mounted on the outer peripheral surface of the valve stopper 32, as best shown in FIG. 5. The discharge valves 19 and the valve stopper 32 are fixed to an inner wall surface of the discharge space 1*c* by two bolts 33 screwed from outside through respective through holes 1*d* formed in the cam ring 1. An O ring 52 is mounted between a bearing surface of a head of each fixing bolt 33 and the cam ring 1.

Refrigerant inlet ports, not shown, are formed in the rear-side end face 1*b* of the cam ring 1, and refrigerant gas is supplied from the suction chamber 11 to the respective compression chambers via the inlet ports.

Next, the operation of the vane compressor constructed as above will be explained.

As torque is transmitted from an engine, not shown, to the drive shaft 7, the rotor 2 is driven for rotation. Refrigerant gas flowing out of a refrigerant outlet port of an evaporator, not shown, is drawn into the suction chamber 11 via the suction port 6*a*. The refrigerant gas is drawn into the compression spaces 12 from the suction chamber 11 via the refrigerant inlet ports.

The compression spaces 12 are each divided by the vanes 14 into five compression chambers, each of which is varied in capacity with rotation of the rotor 2, whereby refrigerant gas trapped in each compression chamber is compressed, and the compressed refrigerant gas opens the discharge valves 19 to flow out via the refrigerant outlet ports 16 into the discharge spaces 1*c*.

The high-pressure refrigerant gas flowing into the discharge spaces 1*c* further flows into the discharge chamber 10, followed by being discharged via a discharge port, not shown.

According to the above embodiment, the front side block 3 is received in the front head 5, and no rear side block is employed, but the rear head 6 is directly secured to the rear-side end face 1*b* of the cam ring 1. Therefore, no component parts of the vane compressor except the cam ring 1 and the front and rear heads 5 and 6 are exposed to the space outside the compressor. That is, the number of component parts exposed to the space outside the compressor or atmosphere is reduced compared with the conventional vane compressors. As a result, a smaller number of interfaces between component parts require sealing, which makes the compressor less prone to leakage of refrigerant gas.

Further, the front-side end face 2*a* of the rotor 2 can be brought into sliding contact with the front side block 3 during rotation of the rotor 2. However, the front side block 3 formed of ferrous material has excellent sliding characteristics, and therefore it is possible to prevent seizure from occurring between its rotor-side end face and the front-side end face 2*a* of the rotor 2 without carrying out the surface treatment thereof, which enhances the reliability of the compressor.

Moreover, since the front side block 3 and the radial bearing 8 are both formed of ferrous material, there is very little space produced between the radial bearing 8 and the front side block 3 when the radial bearing 8 and the front side block 3 undergo thermal expansion, which prevents the radial bearing 8 from becoming loose. Therefore, it is not required to form a recess in the front side block to provide space around the bearing 8 for casting a bushing of ferrous material therein, which facilitates the machining of the front side block 3.

In addition, since the front side block 3 is received in the front head 5, the longitudinal length of the vane compressor can be shortened. Further, since the discharge valve 19 is formed by a cartridge valve, construction of portions or members associated with the discharge valves 19 is simplified. Still further, since the discharge valves 19 are fixed to the inner wall surface of the discharge space 1*c* by bolts 33 from outside the cam ring 1, it is possible to manufacture the discharge valves 19 within a more exacting tolerance with a reduced number of machining steps at reduced cost. Integration of a rear-side block into the rear head 6 also contributes to reduction of the manufacturing costs.

It is further understood by those skilled in the art that the foregoing is the preferred embodiment of the invention, and that various changes and modification may be made thereto without departing from the spirit and scope thereof.

What is claimed is:

1. A vane compressor comprising:

a cam ring;

a rotor rotatably received in said cam ring;

a first head secured to a first end face of said cam ring;

a second head secured to a second end face of said cam ring such that said second head closes an opening of said second end face of said cam ring, and such that one end face of said rotor can be brought into contact with said second head; and a side block received within said first head such that said side block closes an opening of said first end face of said cam ring, and such that another end face of said rotor can be brought into contact with said side block;

wherein an inner wall surface of said first head, an outer peripheral surface of said side block, and said first end face of said cam ring define a discharge chamber; and wherein said second head defines therein a suction chamber.

2. A vane compressor according to claim 1, wherein said first head is located on a front side of said cam ring.

3. A vane compressor according to claim 2, wherein said rotor is formed of an aluminum-based material, and wherein said side block is formed of a ferrous material.

4. A vane compressor according to claim 2, wherein said rotor is rigidly fitted on a drive shaft, and a bearing is arranged in said side block for rotatably supporting said drive shaft, said bearing being formed of a ferrous material.

* * * * *